US006888055B2

(12) United States Patent
Smith et al.

(10) Patent No.: US 6,888,055 B2
(45) Date of Patent: May 3, 2005

(54) GUITAR NECK SUPPORT ROD

(75) Inventors: Dan Smith, Corona, CA (US); George Blanda, Corona, CA (US)

(73) Assignee: Fender Musical Instruments, Scottsdale, AZ (US)

( * ) Notice: Subject to any disclaimer, the term of this patent is extended or adjusted under 35 U.S.C. 154(b) by 0 days.

(21) Appl. No.: 10/192,245

(22) Filed: Jul. 8, 2002

(65) Prior Publication Data

US 2004/0003700 A1 Jan. 8, 2004

(51) Int. Cl.[7] ..... G10D 3/00

(52) U.S. Cl. ..... 84/293; 84/291; 84/292; 84/314 R

(58) Field of Search ..... 84/293, 291, 292, 84/314 R, 267

(56) References Cited

U.S. PATENT DOCUMENTS 4,313,362 A * 2/1982 Lieber ..... 84/267
4,334,456 A * 6/1982 Martin et al. ..... 84/314 R
4,681,009 A * 7/1987 Mouradian ..... 84/293
4,770,929 A * 9/1988 Nobumasa et al. ..... 442/278
4,777,858 A * 10/1988 Petschulat et al. ..... 84/314 R
4,846,038 A 7/1989 Turner ..... 84/293
4,846,039 A 7/1989 Mosher ..... 84/293
4,951,542 A * 8/1990 Chen ..... 84/293
5,333,527 A * 8/1994 Janes et al. ..... 84/291
5,864,073 A 1/1999 Carlson ..... 84/293
6,011,205 A * 1/2000 Tucker et al. ..... 84/291
6,111,175 A 8/2000 Lasner ..... 84/293

* cited by examiner

*Primary Examiner*—Shih-Yung Hsieh
(74) *Attorney, Agent, or Firm*—Jan P. Weir

(57) ABSTRACT

A support rod has a core and has a composite material covering at least a portion of the core. The support rod is suitable for use in enhancing the rigidity of the neck of a musical instrument, such as a guitar. The support rod is also suitable for use in a wide variety of other applications.

63 Claims, 3 Drawing Sheets

FIG. 1
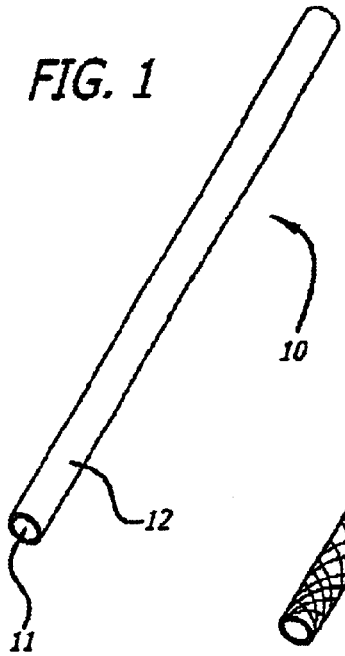
FIG. 1A
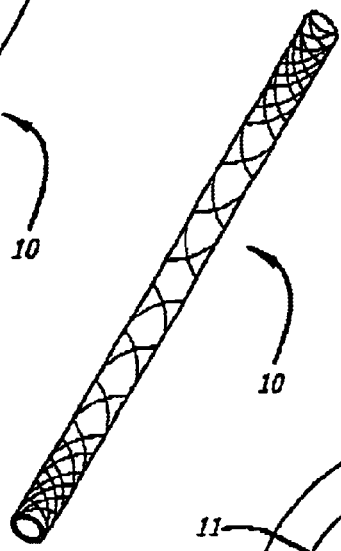
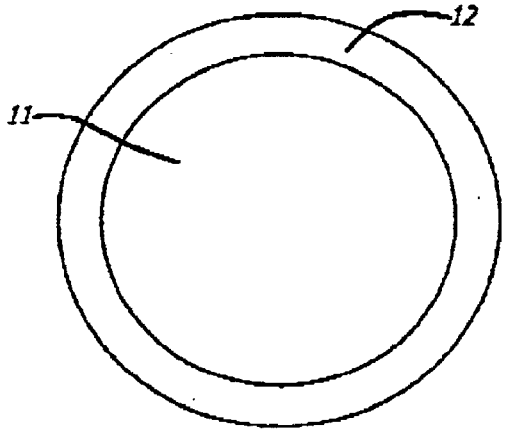
FIG. 2
FIG. 3 (Prior Art)
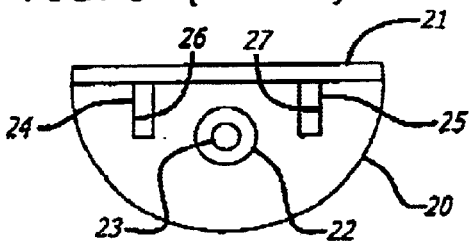
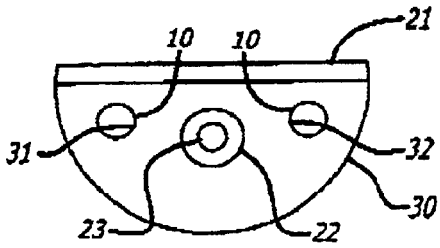
FIG. 4
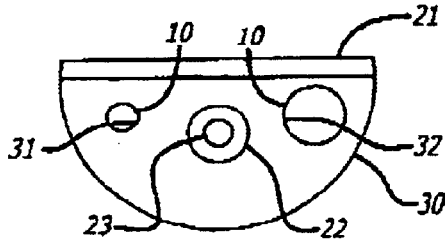
FIG. 4A

GUITAR NECK SUPPORT ROD

FIELD OF THE INVENTION

The present invention relates generally to stringed musical instruments. The present invention relates more particularly to a support rod for mitigating undesirable deformation of the neck of a stringed musical instrument, such as a guitar.

BACKGROUND OF THE INVENTION

Stringed musical instruments having a neck and a body are well known. Guitars, bases, banjos, mandolins, violins, Dobros and ukuleles are examples of such stringed instruments.

It is generally desirable that the neck of a stringed musical instrument have a small amount of bowing in the direction in which the strings tend to pull the neck. Such bowing is desirable so as to accommodate the excursion of a played string. As those skilled in the art will appreciate, a played string requires sufficient clearance with respect to the neck of the musical instrument so as to avoid undesirably contacting the neck or frets of the musical instrument as the string moves back and forth about its unplayed or idle position. Generally, the most clearance is required between a string and the neck of the musical instrument along the central portion of the string, where such excursions tend to be the greatest. Such clearance is provided by forming the neck of a musical instrument, such as a guitar, so as to have a very slight bow when the strings are installed and properly tuned.

However, one common problem associated with stringed musical instruments is undesirable bowing or deformation of the neck of the musical instrument. Such deformation of the neck of a musical instrument may be caused by poor workmanship, poor materials, excessive changes in humidity, excessive temperature, excessive changes in temperature, excessive string tension, or by any combination of these factors.

Typically, such deformation of the neck of a stringed musical instrument results in undesirable bowing of the neck, which inhibits proper playing of the musical instrument. Such bowing most frequently occurs in the direction in which the strings tend to pull the neck. However, such bowing may occur in any other direction, including that direction opposite to the direction in which the strings tend to pull the neck, a direction perpendicular to that direction, or any other direction. The neck of a musical instrument may also deform in various other manners, such as by being deformed into a generally S-shaped curve. It is also possible for the neck to twist, such as generally about it longitudinal centerline.

As those skilled in the art will appreciate, that portion of a stringed musical instrument, such as a guitar, where the neck attaches to the body thereof tends to be a weak point, where undesirable bowing commonly occurs. This attachment point can be thought of as defining a hinge about which the neck pivots (although typically only very slightly) relative to the body, so as to permit bowing due to excessive string tension.

Many stringed instruments have a truss rod or tension rod disposed within the neck thereof for adjusting the amount of bow in the neck of the musical instrument. When a musical instrument having such a tension rod bows at the attachment point of the neck to the body thereof, it is common to attempt to compensate for such bowing by adjusting the tension rod so as to cause the neck to bow in a direction opposite that which occurs at the attachment point. Bowing at the attachment point usually occurs in the direction in which the strings pull the neck. Therefore, the tension rod is adjusted (tightened) so as to cause the neck to bow in the direction which is opposite to that in which the strings pull the neck.

However, it must be appreciated that a tension rod adjusts the amount of bow in the neck by varying the curvature of the neck about the center portion of the length of the neck. Thus, such adjustment of the tension rod changes the curvature of the neck by causing the neck to bend about its own center. However, the bowing of the instrument caused at the attachment point of the neck to the body thereof is occurring at the proximal end (attachment end) of the neck, rather than near the center of the length of the neck. Therefore, such an attempt to compensate for bowing at the attachment point of the neck generally results in the introduction of further undesirable deformation of the neck, rather than compensating for the original deformation at the attachment point. This may result in a generally S-shaped curvature of the neck, which may make the musical instrument unplayable.

Although such deformation is typically very small when measured, it is important to appreciate that even a slight amount of deformation may render a stringed musical instrument unplayable. For example, bowing of the neck of a guitar in the direction in which the strings tend to pull the neck results in a greater distance between the strings and the frets for higher pitched notes than for lower pitched notes on a given string. This is the type of bowing which frequently occurs at the attachment point of the neck to the body of a musical instrument, as discussed above. Such bowing inherently requires that a guitar player push higher pitched notes further downward (to the fingerboard) than lower pitched notes. As those skilled in the art will appreciate, pushing the string further downward in order to play a note stretches the string more, thereby increasing the tension on the string and consequently undesirably increasing the pitch of the resulting note. Thus, the higher pitched notes of a guitar having a neck which is bowed in this manner will be pitched too high and will thus be out of tune.

Bowing of the neck of a guitar in the opposite direction from the direction in which the strings tend to pull the neck causes the strings to be closer to the frets for higher pitched notes on a given string than for lower pitched notes on the same string. This type of bowing may occur when the tension rod is over tightened. When a string is too close to a fret, there is a substantial tendency for that string to buzz, wherein the string contracts the fret when played, thereby resulting in a undesired sound.

Poor workmanship may result in undesirable bowing of the neck of a musical instrument. This may occur, for example, if the neck of the musical instrument is incorrectly attached to the body thereof. Thus, if the neck attachment screws are insufficiently tightened, the neck may be permitted to pivot excessively with respect to the body of the musical instrument, thus resulting in undesirable bowing of the neck of the musical instrument, as discussed above.

Additionally, it is possible for the tension rod to be incorrectly adjusted when the musical instrument is initially set up. Under-tightening the tension rod may result in bowing of the neck in the direction in which the strings tend to pull the neck. Over-tightening of the tension rod may result in bowing of the neck away from the direction in which the strings tend to pull the neck.

The use of poor materials, such as uncured or otherwise defective wood for the neck of a stringed musical instrument may result in undesirable bowing or other deformation thereof. For example, uncured wood tends to bend or deform over time as changes in the moisture content of the wood occur. The use of wood which is not sufficiently strong or rigid may permit the strings to pull the neck so as to cause an undesirable bow therein.

Environmental conditions, such as temperature, humidity, excessive cycling or rapid changes in temperature, and excess cycling or rapid changes in humidity are likely to adversely affect the moisture content of the wood from which the neck of a musical instrument is constructed. Such changes in the moisture content of the wood may result in undesirable changes in the shape of the neck, particularly when the neck is subject to string tension which tends to pull the neck in one direction.

A very common cause of bowing of a neck of a stringed musical instrument, such as a guitar, is over-tightening of the strings thereof. As those skilled in the art will appreciate, the more the strings of a guitar are tightened, the more tension the strings apply to the neck of the guitar, so as to urge the neck of the guitar to bend or bow in the direction in which the strings pull the neck.

Deformation of the neck of a musical instrument due to poor workmanship, such as incorrect attachment of the neck to the body of the musical instrument, cannot be properly compensated for with the tension rod, as discussed above.

Deformation of the neck of a musical instrument due to poor materials and/or environmental conditions can generally be compensated for when the deformation is simple. This is, if such deformation merely results in bowing of the neck of the musical instrument, then the tension rod may be effective in compensating for such deformation. However, deformation due to the use of poor materials and/or adverse environmental conditions may result in more complex deformation of the neck of a musical instrument, which cannot be corrected by adjusting the tension rod.

In view of the foregoing, it should be appreciated that although adjustment of the tension rod of a stringed musical instrument may compensate for simple bowing of the neck of a musical instrument when such bowing occurs proximate a center portion of the length to the neck, adjustment of a tension rod is not effective in compensating for other types of deformation of the neck of a stringed musical instrument, such as bowing about the attachment point of the neck and such as complex deformation of the neck.

Moreover, any substantial deformation of the neck of a musical instrument results in an undesirable change in the relative position of the strings with respect to the neck (and, consequently with respect to the frets), frequently in a manner which inhibits proper playing of the musical instrument. As such, it is highly desirable to mitigate such deformation of the neck of a stringed musical instrument.

One contemporary attempt to mitigate such undesirable deformation of the neck of a stringed musical instrument involves the placement of two graphite or metal rails into two longitudinally extending grooves formed substantially along the length of the neck. These rails are placed immediately under the fingerboard. Such graphite or metal rails are inherently rigid and thus tend to resist deformation of the neck of the musical instrument.

However, the use of such metal rails inherently increases the weight of the stringed musical instrument, particularly of the neck thereof. Increasing the weight of a stringed musical instrument, such as a guitar, generally makes the musical instrument less comfortable and more difficult to play. Further, increasing the weight of the neck of such a musical instrument undesirably affects the balance thereof, again generally making the musical instrument less comfortable and more difficult to play.

Additionally, the use of such metal rails undesirably alters the tone of the stringed musical instrument. As those skilled in the art will appreciate, metal is substantially denser than wood and has acoustic properties which are substantially different from those of wood.

It is also known to form a guitar neck of graphite-epoxy composite material. Although such a graphite-epoxy composite guitar neck is very strong and is very resistant to undesirable deformation, the tone of a guitar having a graphite-epoxy composite neck is not desirable.

It is worthwhile to appreciate that the desired tone of a stringed musical instrument is typically a tone which has been historically determined. That is, it is generally desirable for newer stringed musical instruments to mimic the tone of older stringed musical instruments, since it is the older stringed musical instruments which were used to produce the music which we are accustomed to hearing. Therefore, changes in the construction of a stringed musical instrument should typically be made in a manner which does not substantially alter the tone of the musical instrument from that which the buying and listening public has become accustomed to hearing.

Moreover, it has been found that the use of some high strength materials, such as metals, to strengthen the neck of a stringed musical instrument undesirably changes the tone thereof. Therefore, the use of such materials does not provide a satisfactory solution to the problem of undesirable deformation of the neck of stringed musical instruments.

It is also worthwhile to appreciate that a guitar neck should have some flexibility. It is generally desired that a guitar neck have an amount of flexibility which, like tone, has been historically determined. That is, guitar players have become accustomed to the neck of a guitar having some flexibility. Guitar players prefer that the necks of newer guitars likewise have such flexibility. Even though the amount of flexibility of a guitar neck is very small, it does affect the feel and playability of the musical instrument.

The use of graphite or metal rails, as discussed above, undesirably over stiffens the neck of the musical instrument. Similarly, a neck formed of graphite-epoxy composite material is almost completely lacking in flexibility. Therefore, the use of such contemporary graphite or steel rails and the construction of a neck entirely of graphite-epoxy composite material provide a neck which is undesirably stiff.

In view of the foregoing, it is desirable to mitigate deformation of the neck of a stringed musical instrument in a manner which does not substantially increase the weight or alter the balance of the musical instrument and in a manner which does not undesirably alter the tone of the musical instrument or the flexibility of the neck thereof.

SUMMARY OF THE INVENTION

The present invention specifically addresses and alleviates the above-mentioned deficiencies associated with the prior art. More particularly, the present invention comprises a support rod having a core and a composite material covering at least a portion of the core. Although the support rod finds particular application in guitar necks, the support rod of the present invention is also suitable for application in a wide variety of other musical instruments.

These, as well as other advantages of the present invention, will be more apparent from the following description and drawings. It is understood that changes in the specific structure shown and described may be made within the scope of the claims without departing from the spirit of the invention.

BRIEF DESCRIPTION OF THE DRAWINGS

These, as well as other features, aspects and advantages of the present invention, will be more fully understood when considered with respect to the following detailed description, appended claims and accompanying drawings, wherein:

FIG. 1 is a perspective view of a support rod of the present invention;

FIG. 1A shows an alternate embodiment of a support rod of the present invention;

FIG. 2 is an end view of the support rod of FIG. 1;

FIG. 3 is a cross-sectional end view taken along line 3 of FIG. 9, of a prior art guitar neck having two steel or graphite rail supports disposed therein;

FIG. 4 is a cross-sectional end view taken along line 3 of FIG. 9, of a first configuration of a guitar neck having a plurality of support rods disposed therein, according to the present invention;

FIG. 4A is a cross-sectional end view taken along line 3 of FIG. 9, of an alternate first configuration of a guitar neck having a plurality of support rods of varying diameters disposed therein, according to the present invention;

DETAILED DESCRIPTION OF THE INVENTION

Figure 5:
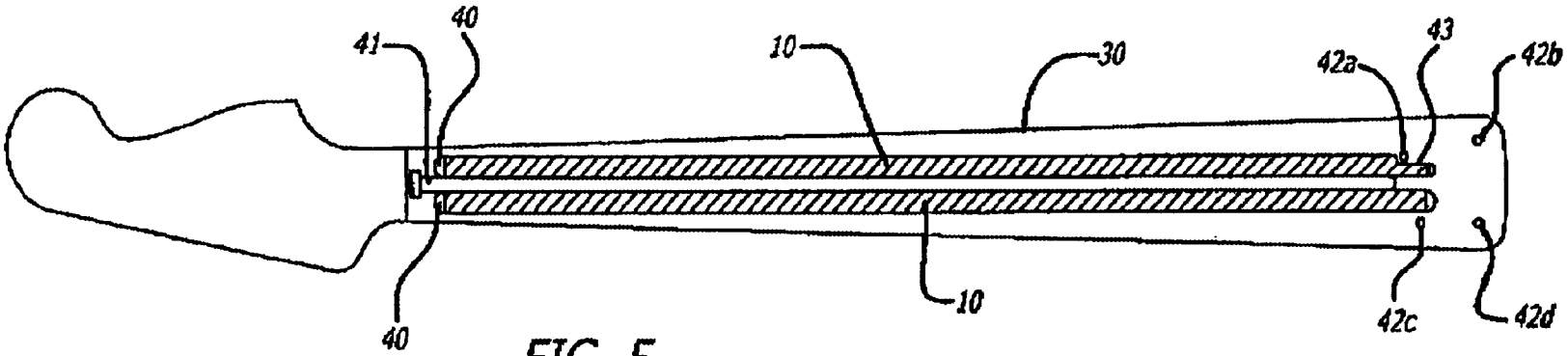
FIG. 5 is a front view of guitar neck showing two support rods disposed in channels or grooves formed in the guitar neck, according to the present invention.

The detailed description set forth below in connection with the appended drawings is intended as a description of the presently preferred embodiments of the invention, and is not intended to represent the only forms in which the present invention may be constructed or utilized. The description sets forth the functions of the invention and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

More particularly, the present invention comprises a support rod comprising a core and a composite material covering at least a portion of the core. The core preferably comprises wood, preferably a single piece of cured wood. Alternatively, the core may comprise a plurality of separate pieces of wood which have been attached to one another, such as via adhesive bonding. As further alternatives, the core may comprise a polymer material or metal.

The support rods of the present invention enhance the strength of the neck of a musical instrument, such as a guitar, so as to substantially inhibit undesirable deformation thereof. That is, the support rods, particularly the composite coverings thereof, add strength to the neck of the musical instrument so as to inhibit bowing, twisting, or other undesirable deformation thereof. The support rods of the present invention provide such resistance to undesirable deformation of the neck of a musical instrument while generally maintaining a desired feel and sound of the musical instrument.

By forming the core of the support rods of the present invention from wood, the amount of wood in the neck of the musical instrument remains substantially constant when the support rods of the present invention are added. Thus, changes in the physical characteristics of the neck of the musical instrument tend to be minimized and the tone of the musical instrument thus remains substantially unchanged. By using a wood core, the present invention tends to avoid removing an excessive quantity of wood from the musical instrument's neck, while adding the structural strength associated with the composite covering. It should be appreciated that although graphite is substantially stronger than wood, its contribution to the tone of a stringed musical instrument is substantially similar to that of wood.

Moreover, it has been found that the use of a support rod having a core formed of wood or a wood-like material provides desired acoustic qualities. That is, the use of a core comprised of wood or a similar material results in a guitar having substantially the same desirable tone as a guitar which lacks such support rods. Thus, the use of a core comprised of wood or a similar material results in an instrument having a historically desirable tone.

It has also been found that the use of a support rod having a core formed of wood or a wood-like material provides desired weight, balance and flexibility. That is, the use of a core comprised of wood or a similar material results in a guitar having substantially the same weight, balance and flexibility of the neck thereof as a guitar which lacks such support rods. Thus, the use of a core comprised of wood or a similar material results in an instrument having historically desired weight, balance, and neck flexibility.

It is generally preferred that the core material have some acoustic damping capability. It has been found that a support rod consisting of only a composite covering (not having a core and thus defining a tube) has undesirable acoustic characteristics. That is, such a tubular support rod tends to vibrate or rattle undesirably. By filling the tubular support rod with a material having desirable acoustic characteristics, such as wood or a structural polymer foam, the strength of the composite covering prevents undesirable deformation of the neck of the musical instrument, while the core inhibits undesirable vibration of the composite covering.

Thus, the composite material adds substantial structural strength which inhibits undesirable deformation of the neck of the musical instrument and the core tends to enhance acoustics. It is the cooperation of the covering and the core that allows construction of a support rod which maintains a desired historic sound.

Preferably, the core is generally circular in cross-section. However, the core may alternatively be oval, rectangular, square, octagonal, hexagonal, or of any other desired cross-sectional configuration. Forming the core such that it is generally circular in cross-section provides radial symmetry which causes a support rod to have substantially the same stiffness in any radial direction. Therefore, the use of such a round support rod enhances the stiffness of the neck of the musical instrument by substantially the same amount in all radial directions. Further, such a round support rod does not need to be assembled into the neck of a musical instrument in any particular angular or rotational orientation thereof. In those instances where different stiffnesses are required in different radial directions, the support rod may have various different cross-sectional configurations.

The composite material preferably comprises a graphite-epoxy composite material. Alternatively, the composite material may comprise a fiberglass-resin composite material or any other composite material which provides sufficient strength to inhibit undesirable deformation of the neck of a musical instrument and which provides a desired tone.

It has been found that the use of graphite-epoxy composite material for the covering facilities control of the tone, weight, and flexibility of the neck of the musical instrument. Graphite-epoxy composite material does not undesirably affect the tone of musical instrument, such that a historically desirable tone can be achieved. Graphite-epoxy composite material is light in weight, such that the weight and balance of the musical instrument is not substantially affected thereby. The stiffness of a support rod having a graphite-epoxy composite material covering can easily be varied along the length thereof, so as to control the flexibility of the neck of the musical instrument.

More particularly, the composite material may comprise a graphite-epoxy material having at least one carbon fiber sheet which is wrapped around the core. The graphite-epoxy material may comprise one woven carbon fiber sheet which is wrapped around the core. Alternatively, the graphite-epoxy material comprises more than one woven carbon fiber sheet. As a further alternative, the graphite-epoxy material may comprise one or more non-woven carbon fiber sheets which are wrapped around the core. Thus, the composite material may comprise any desired number of woven or non-woven carbon fiber sheets and may comprise any combination thereof. That is, the graphite-epoxy material may comprise a plurality of separate sheets, either woven or unwoven, which are wrapped around the core.

The graphite-epoxy material may comprise a plurality of generally unidirectional carbon fiber sheets which are wrapped around the core, optionally such that an orientation of fibers of at least one carbon fiber sheet are generally orthogonal with respect to fibers of another carbon fiber sheet.

Optionally, the composite covering may be formed separately from the core, such as upon a mandrel. After removing the composite covering from the mandrel, the composite covering may be filled with a desired core material, such as a polymer foam.

The core preferably has a diameter of between approximately 4 mm and approximately 10 mm, preferably approximately 6.5 mm. The composite preferably has a thickness of between approximately 0.5 mm and approximately 3 mm, preferably approximately 1 mm.

The support rods of the present invention increase the rigidity of the neck of a guitar or other stringed musical instrument. As discussed above, the necks of such musical instruments are subject to undesirable deformation, such as deformation caused by the use of poor quality materials, defects in workmanship, excessive string tension, excessive temperature, excessive changes in temperature, excessive changes in humidity or any combination of such factors.

The support rods of the present invention may be disposed within bores or grooves formed in the elongate member or neck of a guitar or the like, so as to inhibit such undesirable deformation of the neck. Such bores may be formed, for example, by drilling long holes generally longitudinally along at least a portion of the neck of a musical instrument. Such grooves may be formed, for example, by milling or otherwise machining material away from the front surface of the neck (where the fingerboard is to be later attached).

Although a single support rod may be utilized to enhance the rigidity of the neck of a musical instrument, typically a plurality of such support rods will be utilized. Preferably, each support rod is disposed within a separate groove formed generally longitudinally in the neck of the musical instrument. The support rods may all have the same diameter. Alternatively, a variety of different diameters of the support rods may be utilized. Each support rod may have a generally consistent cross-section taken along the length thereof, or may have a varying cross-section, such that the stiffness and/or strength of the support rod varies along the length thereof. For example, the stiffness and strength of a support rod may be enhanced along end portions thereof by making the composite covering thicker along this portion, such as by wrapping more layers of carbon fiber sheet around the core at the end portions of the support rod. The stiffness and strength of a support rod may alternatively be enhanced along the end portions thereof by utilizing graphite-epoxy composite material having greater strength and stiffness at the ends of the support rod than at the center thereof, as discussed below.

In many instances it will be desirable to provide a neck having flexibility which is similar to the flexibility of contemporary guitar necks. That is, in many instances it will be desirable to provide a guitar neck having a historically desirable amount of flexibility. Typically, this can be achieved by forming the support rods such that the support rods are stiffer at the ends thereof than proximate the central portion thereof. Such support rods tend to mimic the stiffness of traditional guitar necks, wherein the guitar neck is generally stiffer at the ends thereof than proximate the central portion thereof. Although such stiffness of the support rods proximate ends thereof may be accomplished by varying the physical dimensions of the support rods along the length thereof, as dismissed above, it is preferably accomplished by wrapping the core with graphite sheet material having greater strength at the ends of the support rod.

As those skilled in the art will appreciate, wrapping the core with graphite sheet material having greater strength tends to enhance the stiffness of that portion of the core which is so wrapped. Graphite sheet material having greater strength can be graphite sheet having more fibers per square inch, having larger diameter fibers, and/or having fibers which have greater tensile strength.

However, those skilled in the art will appreciate that various other means for enhancing the strength of the support rods proximate the ends thereof all likewise suitable. For example, the amount of graphite-epoxy composite material formed at the ends of the support rod may be greater than the amount of graphite-epoxy composite material formed proximately central portion thereof. As mentioned above and illustrated in FIG. 1A, this may be accomplished by wrapping more layers of graphite material around the ends of the support rod than around the central portion thereof. However, the use of such additional covering at the ends of the support rod will tend to make the support rod have a greater diameter at the ends thereof, unless the core is formed so as to have a smaller diameter at the ends thereof to compensate for such construction. Using a stronger graphite material at the ends of the support rod allows both the covering and the core to have a general uniform diameter along the length thereof.

Allowing the covering and the core to have a generally uniform diameter along the length thereof simplifies the fabrication process of the support rods, since tapered cores are not necessary and since it is generally easier to fabricate a covering having a substantially uniform diameter than it is to fabricate a covering having a desired taper. The use of support rods having a covering and core which have a generally uniform diameter also facilitates the use of bores or grooves having generally uniform cross-sectional dimensions along the length thereof.

Preferably, the support rods are placed within grooves formed within the neck of a musical instrument and are adhesively bonded, such as via epoxy, in place. The fingerboard of the musical instrument preferably covers the grooves. Optionally, the grooves may be covered or plugged with wood, as discussed in detail below.

Optionally, the support rods may be formed so as to have generally flat upper surfaces, such that the upper surfaces of the support rods are disposed generally flush with the front surface of the neck (prior to attaching the fingerboard), such that no additional coverings or plugs are needed.

Optionally, epoxy may be applied over the support rods after the support rods are disposed within their respective grooves, such that the epoxy forms a surface which is approximately flush with the front of the neck (prior to attaching the fingerboard), so as to eliminate the need for any additional coverings or plugs.

Optionally, epoxy may be applied over substantially the entire length of the support rods, so as to mitigate undesirable twisting of the neck, as discussed below.

Alternatively, the support rods may be friction fit to bores formed in the neck. This may be accomplished, for example, by forming each bore generally longitudinally through the neck, such that the bore has a slightly smaller diameter than the outer diameter of the support rod and then forcing the support rod into the bore. Optionally, a lubricant may be used to facilitate insertion of a support rod into a bore. Optionally, an adhesive, such as epoxy, may be applied to the support rods prior to forcing the support rods into the bore, such that the adhesive functions as a lubricant during the insertion process and functions as a bonding agent subsequent to the insertion process.

The support rods are preferably adhesively bonded within the bores, such as via the use of epoxy. The support rods may optionally be disposed within their bores before a final coat of epoxy of the composite material covering thereof is cured, such that the final coat of epoxy of the composite material covering adhesively bonds the support rods within the bores.

Preferably, at least one truss rod or tension rod is also disposed within a bore or groove of the neck, so as to facilitate adjustment of the tension on the neck in a manner which generally opposes the tension due to the strings of the musical instrument, according to well known principles.

Thus, according to the present invention, a musical instrument may be fabricated wherein the neck compromises an elongate member having at least one bore or groove formed generally longitudinally at least partially therethrough and at least one support rod disposed within the bore. The neck is attached to a body, so as to define a stringed musical instrument. A guitar, for example, may be formed in this manner by attaching a guitar neck containing support rods according to the present invention to a guitar body.

Referring now to FIGS. 1 and 2 an exemplary support rod 10 of the present invention comprises a wooden core 11 and a graphite-epoxy material 12 covering substantially the entire length of the core 11. According to this exemplary embodiment, the graphite-epoxy composite material may comprise a single sheet of woven carbon fiber which is wrapped around the wooden core 11. However, as discussed in detail above, various other configurations of the support rod 10 are likewise suitable.

Referring now to FIG. 3, a prior art attempt to mitigate undesirable deformation of a guitar neck is shown. FIG. 3 is a cross-sectional end view of a guitar neck, such as that taken along line 3 of FIG. 7. An elongate member or neck 20 of a musical instrument, such as a guitar, comprises a fingerboard 21, a generally centrally located bore 22 formed longitudinally through the neck 20, and a tension rod 23 disposed within the bore 22. Two graphite or metal rails, 24 and 25, are disposed within grooves 26 and 27 formed within the neck 20, such that the rails 24 and 25 are captured within the grooves 26 and 27 by the fingerboard 21.

The graphite or metal rails 24 and 25 are generally effective in inhibiting undesirable deformation of the neck 20. However, as those skilled in the art will appreciate, the rails, 24 and 25, are undesirably heavy and thus inherently increase the weight of the musical instrument. The rails, 24 and 25, also undesirably affect the balance of the musical instrument. Additionally, the use of such metal rails, 24 and 25, undesirably affects the tone of the musical instrument. That is, the tone of a musical instrument having such metal rails, 24 and 25, is typically substantially different from a historically desired tone.

Figure 6:
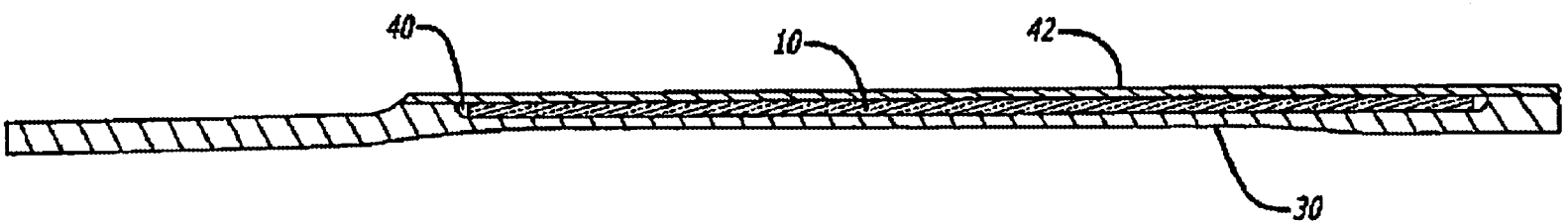
FIG. 6 is a cross-sectional side view taken along the center line of one of the support rods of FIG. 5.

Referring now to FIGS. 4–6, according to the present invention a plurality of support rods (such as the support rod 10 shown in FIGS. 1 and 2) are disposed within bores or grooves formed in the elongate member or neck of a musical instrument. As discussed above, bores are typically formed via drilling and grooves are typically formed via milling. It is worth noting that, although bores and grooves are substantially different in the manner in which they are formed, bores and grooves generally result in a substantially similar configuration of the guitar neck after the support rods 10 have been disposed therein and the grooves have been covered or plugged. That is the coverings or plugs of grooves, when in place, cause the grooves to essentially become bores.

FIG. 4 shows two support rods disposed within bores, such as bores formed by drilling holes generally longitudinally along the length of a guitar neck. FIGS. 5 and 6 show support rods disposed within channels or grooves formed generally longitudinally along the upper surface of a guitar neck, prior to plugging the grooves and adding the fingerboard. In either instance, a tension rod may optionally be used to vary the tension on the neck of the musical instrument.

With particular reference to FIG. 4, two support rod bores 31 and 32 are disposed generally symmetrically upon opposite sides of the tension rod bore 22 and contain support rods 10. Each bore, 31 and 32, preferably extends generally longitudinally through the neck 30 for substantially the entire length of the neck 30. According to the preferred embodiment of the present invention, the support rods 10 are epoxied within the bores 31 and 32. However, as discussed above, the support rods 10 may alternatively be pressed fit into the bores 31 and 32. The support rods 10 and their associated bores, 31 and 32, are preferably approximately the same diameter and length.

Any desired number of support rods 10 of the present invention may be used. Such support rods 10 preferably extend generally longitudinally along the length of the neck of the musical instrument. However, the length, position and configuration (how the stiffness varies along the length of each rod due to variations in cross-sectional dimensions and/or materials) of the support rods within the neck of the musical instrument may be varied, as desired. Thus, the number, length, position and configurations of the support rods 10 can be varied so as to provide enhanced rigidity, where such rigidity is desired. For example, the support rods 10 may be formed so as to provide greater rigidity proximate the ends of the neck than along a central portion thereof, as discussed below. FIG. 4A shows an embodiment of the present invention wherein the support rods 10 have different diameters.

Moreover, the number, length, position and configuration of the support rods 10 can be provided so as to accommodate a particular string gage or range of string gages.

Referring now to FIGS. 5 and 6, two support rods 10 are disposed within channels or grooves 40 formed in the neck 30 of a musical instrument, such as a guitar. Each groove 40 is preferably formed in the neck via a machining process, such milling. Preferably, each groove 40 extends generally longitudinally along substantially the entire length of the neck and each groove 40 is formed along side the central groove 41, within which a tension rod is preferably disposed. A fingerboard 42 (FIG. 6) is formed over the grooves 40.

Holes 42*a–d* (FIG. 5) facilitate attachment of the neck 30 to the body of a guitar. Optionally, one or both of the support rods 10 may comprise a cutout 43 or other modification formed proximate one end thereof, so as to avoid interference with a screw or bolt which passes through one of the holes, such as 42*a*. Alternatively, the neck 30 may be adhesively bonded to the body of the guitar or otherwise formed or attached thereto.

Figure 7:
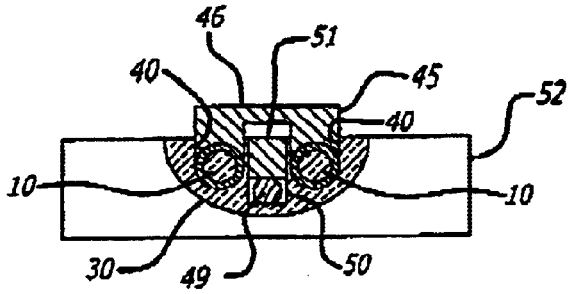
FIG. 7 is a cross-sectional end view showing an assembly process for forming a guitar neck according to the present invention, taken from a position generally corresponding to line 3 of FIG. 9.
Figure 8:
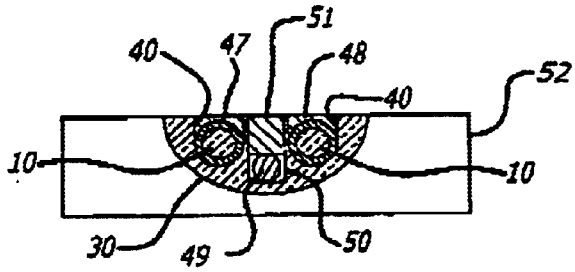
FIG. 8 is a cross-sectional end view showing one result of the assembly process of FIG. 7.

Referring now to FIGS. 7 and 8, one preferred method for assembling the support rods 10 within the neck 30 of a musical instrument, such as a guitar, is shown. According to this preferred method of assembly, a common plug 45 is formed so as to simultaneously plug both grooves 40 after the support rods 10 have been placed within the grooves 40.

The support rods 10 are preferably epoxied within the grooves 40 and the common plug 45 is then preferably epoxied within the grooves 40, atop the support rods 10. The uppermost portion 46 of the common plug 40 is then removed, such as via milling, to provide the configuration as shown in FIG. 8. Thus, separate plugs 47 and 48 remain within the neck 30. A fingerboard may then be attached to the neck according to contemporary practice.

The support rods 10 are preferably epoxied along substantially the entire length thereof within the grooves 40. By epoxing the support rods 10 within the grooves 40, particularly along substantially the entire length of the support rods 10, undesirable twisting of the neck of the musical instrument is substantially inhibited. The support rods 10 of the present invention are comparatively resistant to twisting or torsional deformation, and thus tend to substantially inhibit such twisting or torsional deformation of the neck of the musical instrument.

Optionally, a tension rod 49 is disposed within in a channel 50 and a plug 51 is inserted within the tension rod channel 50 above the tension rod 49 and is similarly epoxied in place. The tension rod 49 may be used to adjust the amount of bowing in the neck of a musical instrument, so as to provide the desired amount of bowing.

The ability to adjust the amount of bowing in the neck of a musical instrument, such as a guitar, is particularly important when the gage of the strings is changed. As those skilled in the art will appreciate, heavier gage strings tend to apply more tension to the neck of a guitar, thus tending to cause the neck of guitar to bow to a greater extent in the direction in which the strings tend to pull the neck. Conversely, lighter gage strings tend to cause less such bowing. Therefore, when the gage of the strings is changed, it is frequently necessary to adjust the tension rod 49, such that the desired amount of bowing of the neck of the musical instrument is maintained.

The neck 30 is preferably formed from a block of wood 52 after the support rods 10 and/or tension rod 49 have been assembled into their respective grooves. That is, first the support rod grooves 40 and the tension rod groove 50 are formed within a block of wood 52, then the support rods 10 and the tension rod 49 are epoxied into their respective grooves. The support rod plugs 40 and the tension rod plug 51 are formed as discussed above and are epoxied into their respective grooves. Finally, the neck 30 is formed by machining, i.e., milling, away excess wood from the block 52.

Those skilled in the art will appreciate that various other means for securing the support rods 10 within channels, grooves, bores or the like, within a musical instrument neck, are likewise suitable.

Figure 9:
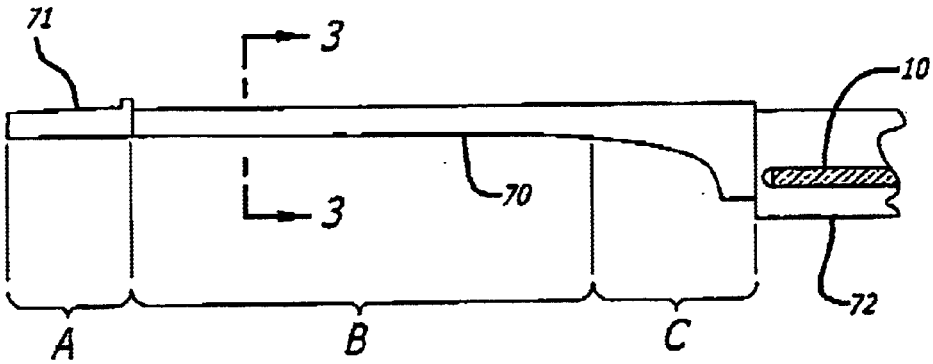
FIG. 9 is a side view of a guitar neck, showing the guitar neck divided into sections according to a desired rigidity of each section.

Referring now to FIG. 9, a guitar neck 70 is shown having a peg head 71 formed to the distal end thereof and having a guitar body 72 attached to the proximal end thereof. Section A is defined by the peg head 71 and is generally a section of inherently high stiffness. Typically, it will not be necessary to enhance the rigidity of Section A via the use of support rods according to the present invention. However, if desired, support rods of the present invention may optionally extend through Section A.

Section B is defined by most of the length of the neck 70 and is that section of the neck 70 which generally requires enhanced rigidity, so as to inhibit undesirable deformation thereof. Therefore, the support rods 10 of the present invention will typically extend through a substantial portion, typically all, of this portion of the neck 70.

Section C of the neck 70 is that portion of the neck 70 where the neck 70 attaches to the body 72 of a guitar. This section of the neck has an increased cross-sectional area and thus tends to be inherently stiff. The support rods 10 of the present invention may optionally extend into this section, if desired. As shown in FIGS. 5 and 6, the support rods 10 extend through substantial portions of Section B and Section C.

When it is desirable for the support rods of the present invention to provide flexibility which is similar to the historically desirable flexibility of a musical instrument, then the support rods may be formed such that they are stiffer proximate the ends thereof than at a central portion thereof, as discussed above. In this instance, the support rods will provide greater stiffness along the length of the neck proximate the peg head and proximate the attachment of the neck to the body, than along a central portion of the neck.

The support rods 10 of the present invention may additionally be used within the body 72 of the guitar or other musical instrument, so as to provide enhanced rigidity, where desired. For example, FIG. 9 shows an embodiment of the present invention having one or more of the support rods 10 positioned within the body 72. Optionally, the support rods 10 may extend either longitudinally or transversely across the body 72, either in contact with the soundboard or back thereof, or not in contact with the soundboard or back thereof, as desired.

Figure 10:
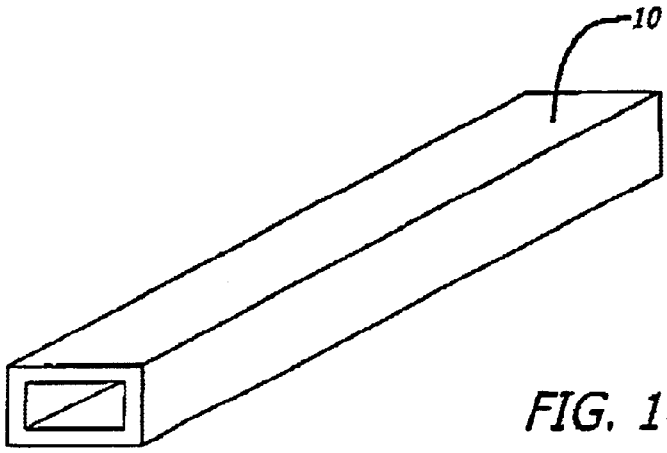
FIG. 10 is a perspective view of a square support rod 10 which may be positioned with the neck 70 or body 72 of a musical instrument.

The support rods 10 of the present invention need not be generally circular in configuration. For example, if the support rods 10 of the present invention are to be disposed within the body 72 of a guitar and are to be in contact with either the soundboard or back of the guitar body 72, then the support rods 10 preferably have a flat portion extending along at least a portion of the length thereof to facilitate such contact. In this instance, the support rods 10 may, for example, be formed so as to be generally square in cross-sectional configuration, so as to provide such a flat surface. FIG. 10 shows an embodiment of a square support rod 10 which may be positioned with the neck 70 or body 72 of a musical instrument.

Where adhesive bonding, such as via the use of epoxy, is disclosed herein, DP100 epoxy, provided by the 3M Corporation of St. Paul, Minn., may generally be used.

In view of the foregoing, the present invention provides a stringed musical instrument neck support rod which substantially mitigates undesirable bowing or deformation of the neck of a stringed musical instrument while generally maintaining a desired sound and feel of the musical instrument. The support rod of the present invention does not undesirably alter the tone of a stringed musical instrument, so as to tend to maintain a historically desirable sound thereof. Further, the support rod of the present invention does not add substantial weight to the musical instrument, such that desired weight and balance tends to be maintained. The flexibility of the neck can be controlled by varying the stiffness of the support rods and by varying how the stiffness of the support rods change along the length thereof, so as to provide an instrument having a neck which has desired flexibility.

Although the exemplary embodiment is described and illustrated herein as a support rod for a guitar neck, such description and illustration is by way of example only, and not by way of a limitation. Those skilled in the art will appreciate that the support rod of the present invention may similarly be used in various other stringed musical instruments.

It is understood that the exemplary support rod, neck, and musical instrument described herein and shown in the drawings represent only presently preferred embodiments of the invention. Indeed, various modifications and additions may be made to such embodiments without departing from the spirit and scope of the invention. For example, the support rod need not be generally straight in configuration. That is, the support rod of the present invention may alternatively be formed into a U-shape, S-shape, annular shape, or any other desired shape. Further, the support rod of the present invention need not have a generally constant cross-sectional configuration. That is, one end of a support rod may have a generally square cross-sectional configuration, while the other end thereof has a generally triangular cross-sectional configuration, for example. Thus, these and other modifications and additions may be obvious to those skilled in the art and may be implemented to adapt the present invention for use in a variety of different applications.

What is claimed is:

1. A support rod for a neck of a musical instrument, the neck being constructed of wood, the support rod comprising:

a core constructed of wood;

a composite material covering at least a portion of the core; and wherein the core and the composite material are configured to be disposed within a neck of a musical instrument.

2. The support rod as recited in claim 1, wherein the wood core has stiffness properties and composite material covering has stiffness properties greater than the core.

3. The support rod as recited in claim 1, wherein the core comprises a single piece of wood.

4. The support rod as recited in claim 1, wherein the core comprises cured wood.

5. The support as recited in claim 1, wherein the wood core has a density and the composite material has a density greater than the wood core.

6. The support rod as recited in claim 1, wherein the core is generally circular in cross-section.

7. The support rod as recited in claim 1, wherein the composite covering is formed so as to provide greater stiffness proximate ends thereof that of a central portion thereof.

8. The support rod as recited in claim 1, wherein the composite material comprises a graphite-epoxy material.

9. The support rod as recited in claim 1, wherein the composite material comprises a graphite-epoxy material having at least one carbon fiber sheet which is wrapped around the core.

10. The support rod as recited in claim 1, wherein the composite material comprises a graphite-epoxy material having at least one woven carbon fiber sheet which is wrapped around the core.

11. The support rod as recited in claim 1, wherein the composite material comprises a graphite-epoxy material having at least one non-woven carbon fiber sheet which is wrapped around the core.

12. The support rod as recited in claim 1, wherein the composite material comprises a graphite-epoxy material having a plurality of generally unidirectional carbon fiber sheets which are wrapped around the core.

13. The support rod as recited in claim 1, wherein the composite material comprises a graphite-epoxy material having a plurality of generally unidirectional carbon fiber sheets which are wrapped around the core such that a orientation of fibers of at least one carbon fiber sheet are generally orthogonal with respect to fibers of another carbon fiber sheet.

14. The support rod as recited in claim 1, wherein:

the core has a diameter of between approximately 4 mm and approximately 10 mm; and the composite material has a thickness of between approximately 0.5 mm and approximately 3 mm.

15. The support rod as recited in claim 1, wherein:

the core has a diameter of approximately 6.5 mm; and the composite material has a thickness of approximately 1 mm.

16. A neck for a musical instrument, the neck comprising:

an elongate member constructed of a first material;

at least one support rod disposed within the elongate member, the support rod(s) comprising:

a core constructed of the first material; and a second material covering at least a portion of the core.

17. The neck as recited in claim 16, wherein the elongate member is configured to at least partially define a guitar neck.

18. The neck as recited in claim 16, wherein the elongate member comprises wood.

19. The neck as recited in claim 16, wherein the elongate member comprises a single piece of wood.

20. The neck as recited in claim 16, wherein the support rod(s) comprise a plurality of support rods, each support rod having substantially the same diameter.

21. The neck as recited in claim 16, wherein the support rod(s) comprise a plurality of support rods, at least two of the support rods having substantially different diameters.

22. The neck as recited in claim 16, further comprising at least one tension rod disposed within the elongate member.

23. The neck as recited in claim 16, wherein the support rod(s) are disposed within grooves formed in the elongate member.

24. The neck as recited in claim 16, wherein the support rod(s) are disposed within bores formed in the elongate member.

25. The neck as recited in claim 16, wherein the support rod(s) are epoxied to the elongate member.

26. A musical instrument comprising:

a neck comprising:

an elongate member constructed of a material having stiffness properties;

at least one support rod disposed within the elongate member, the support rod(s) comprising:

a core constructed of a material having stiffness properties less than or equal to the elongate member; and a composite material having stiffness properties greater than the elongate member covering at least a portion of the core; and a body attached to the neck.

27. The musical instrument as recited in claim 26, wherein the neck defines a guitar neck and the body defines a guitar body.

28. A neck for a guitar, comprising:

an elongate member constructed of a material having stiffness properties;

at least one support rod disposed within the elongate member, the support rod(s) comprising:

a core constructed of a material having stiffness properties less than or equal to the elongate member, and a composite material having stiffness properties greater than the elongate member covering at least a portion of the core.

29. A guitar comprising:

a guitar neck comprising:

an elongate member constructed of a first material;

at least one neck support rod disposed within the elongate member, the neck support rod(s) comprising:

a core constructed of the first material; and a second material covering at least a portion of the core; and a guitar body attached to the guitar neck.

30. The guitar as recited in claim 29, further comprising at least one body support rod disposed within the body and configured to support at least a portion of the body, the body support rod(s) comprising:

a core; and a composite material covering at least a portion of the core.

31. A guitar comprising:

a guitar neck;

a guitar body constructed of a first material having a density attached to the guitar neck;

at least one body support rod disposed within the guitar body and configured so as to provide support to at least a portion of the body, the body support rod(s) comprising:

a core constructed of the material having a density less than or equal to the first material; and a second material covering at least a portion of the core having a density greater than the first material.

32. The guitar as recited in claim 31, further comprising at least one neck support rod disposed within the neck, the neck support rod(s) comprising:

a core constructed of a material having stiffness properties; and a composite material covering at least a portion of the core, the composite material constructed of a material having stiffness properties greater than the core material.

33. A method for making a support rod for the neck of a musical instrument, the neck being constructed of a material having a density, the method comprising:

providing a core constructed of a material having a density less than or equal to the neck;

covering at least a portion of the core with a composite material; and positioning the core and the composite material within a neck of a musical instrument.

34. The method as recited in claim 33, wherein the core comprises wood.

35. The method as recited in claim 33, wherein the core comprises a single piece of wood.

36. The method as recited in claim 33, wherein the core comprises cured wood.

37. The method as recited in claim 33, wherein the core comprises polymer.

38. The method as recited in claim 33, wherein the core is generally circular in cross-section.

39. The method as recited in claim 33, wherein the core is generally rectangular in cross-section.

40. The method as recited in claim 33, wherein the composite material comprises a graphite-epoxy material.

41. The method as recited in claim 33, wherein the composite material comprises a graphite-epoxy material having at least one carbon fiber sheet which is wrapped around the core.

42. The method as recited in claim 33, wherein the composite material comprises a graphite-epoxy material having at least one woven carbon fiber sheet which is wrapped around the core.

43. The method as recited in claim 33, wherein the composite material comprises a graphite-epoxy material having at least one non-woven carbon fiber sheet which is wrapped around the core.

44. The method as recited in claim 33, wherein the composite material comprises a graphite-epoxy material having a plurality of generally unidirectional carbon fiber sheets which are wrapped around the core.

45. The method as recited in claim 33, wherein the composite material comprises a graphite-epoxy material having a plurality of generally unidirectional carbon fiber sheets which are wrapped around the core such that a orientation of fibers of at least one carbon fiber sheet are generally orthogonal with respect to fibers of another carbon fiber sheet.

46. The method as recited in claim 33, wherein:

the core has a diameter of between approximately 4 mm and approximately 10 mm; and the composite material has a thickness of between approximately 0.5 mm and approximately 3 mm.

47. The method as recited in claim 33, wherein:

the core has a diameter of approximately 6.5 mm; and the composite material has a thickness of approximately 1 mm.

48. A method for supporting a musical instrument neck, the neck being constructed of wood, the method comprising:

constructing a core of wood; and covering at least a portion of the core with a composite material to form at least one support rod; and supporting the musical instrument neck with the at least one support rod disposed within the musical instrument neck.

49. A method for supporting a guitar neck, the neck being constructed of a material having stiffness, the method comprising:

constructing a core of a material having a stiffness less than or equal to the neck; and covering at least a portion of the core with a composite material having stiffness greater than the neck to form at least one support rod; and supporting the guitar neck with the at least one support rod disposed within the guitar neck.

50. A method for making a musical instrument neck, the method comprising:

constructing an elongate member from a material having a stiffness;

forming at least one groove generally longitudinally within the elongate member;

placing at least one support rod into at least one groove;

wherein the support rod(s) comprises:

a core having a stiffness less than or equal to the elongate member; and a composite material having a stiffness greater than then neck covering at least a portion of the core.

51. The method as recited in claim 50, further comprising placing a plug over each support rod.

52. The method as recited in claim 50, further comprising adhesively bonding each support rod within the groove(s).

53. The method as recited in claim 50, further comprising epoxying each support rod within the groove(s).

54. A method for making a guitar neck, the method comprising:

constructing an elongate member suitable for fashioning into a guitar neck out of a material having density;

forming at least one groove generally longitudinally within the elongate member;

inserting at least one support rod into at least one groove;

wherein the support rod(s) comprises:

a core constructed out of a material having the a density less than or the same as the neck; and a composite material covering at least a portion of the core.

55. The method as recited in claim 54, further comprising adhesively bonding each support rod within the groove(s).

56. The method as recited in claim 54, wherein inserting at least one support rod into at least one groove comprises friction fitting at least one support rod into at least one groove.

57. A method for making a musical instrument, the method comprising:

providing an elongate member constructed of a material;

forming at least one groove generally longitudinally within the elongate member;

inserting at least one support rod into at least one groove;

wherein the support rod(s) comprises:

a core constructed of the same material as the elongate member;

a composite material covering at least a portion of the core; and attaching the elongate member to a body.

58. A method for making a guitar, the method comprising:

providing an elongate member constructed of a material having stiffness properties suitable for fashioning into a guitar neck;

forming at least one groove generally longitudinally within the elongate member;

inserting at least one support rod into at least one groove;

wherein the support rod(s) comprises:

a core constructed of a material having stiffness properties less than or equal to the elongate member;

a composite material having stiffness properties greater than the elongate member covering at least a portion of the core; and attaching the elongate member to a guitar body.

59. A method for forming a support rod for a musical instrument, the method comprising:

forming a composite covering from a material having stiffness properties; and filling the composite covering with a core material having stiffness properties less than the composite covering.

60. The method as recited in claim 59, wherein forming a composite covering comprises forming a composite cover over a mandrel.

61. The method as recited in claim 59, wherein filling the composite covering with a core material comprises filling the composite covering with a sound damping material.

62. The method as recited in claim 59, wherein filling the composite covering with a core material comprises filling the composite covering with a core material comprised of polymer foam.

63. A support rod for a musical instrument, the support rod comprising:

an elongate core constructed of a material having stiffness properties and having a generally constant diameter along a length of the core;

a composite material having stiffness properties greater than the core covering substantially the entire length of the core and having a generally constant diameter along a length of the covering; and wherein at least one of the composite material's proximate ends is stronger than composite material's central portion, so as to make the at least one end portion of the support rod stiffer than a central portion thereof.

* * * * *